US007040108B1

(12) United States Patent
Flammang

(10) Patent No.: US 7,040,108 B1
(45) Date of Patent: May 9, 2006

(54) AMBIENT THERMAL ENERGY RECOVERY SYSTEM

(76) Inventor: Kevin E. Flammang, 3480-440th St., Orange City, IA (US) 51041

( * ) Notice: Subject to any disclaimer, the term of this patent is extended or adjusted under 35 U.S.C. 154(b) by 70 days.

(21) Appl. No.: 10/737,100

(22) Filed: Dec. 16, 2003

(51) Int. Cl.
*F25B 27/00* (2006.01)

(52) U.S. Cl. ..... 62/238.6

(58) Field of Classification Search ..... 62/228.1, 62/235.1, 238.6, 238.7
See application file for complete search history.

(56) References Cited

U.S. PATENT DOCUMENTS 4,302,942 A * 12/1981 Charters et al. ..... 62/235.1
4,314,456 A 2/1982 Harnish
4,481,788 A 11/1984 Yoshino
4,540,874 A 9/1985 Shaffer, Jr. et al.
4,592,206 A 6/1986 Yamazaki et al.
5,056,588 A * 10/1991 Carr ..... 165/10
5,255,338 A 10/1993 Robinson, Jr. et al.
5,277,038 A * 1/1994 Carr ..... 62/434
5,367,602 A 11/1994 Stewart
5,471,851 A 12/1995 Zakryk
5,941,091 A * 8/1999 Broadbent ..... 62/347
6,138,744 A * 10/2000 Coffee ..... 165/45
6,212,894 B1 4/2001 Brown et al.
6,408,633 B1 * 6/2002 Carr ..... 62/99

* cited by examiner

*Primary Examiner*—Melvin Jones
(74) *Attorney, Agent, or Firm*—McKee, Voorhees & Sease, P.L.C.

(57) ABSTRACT

A method and system for recovering thermal energy from an ambient environment includes an evaporator plate assembly located in the ambient environment, such as outdoors to absorb thermal energy from air. A compressor, heat exchanger, and water storage tank are located indoors. Fluid lines provide a closed circuit between the evaporator plate assembly, the compressor, and the heat exchanger. Water lines provide a flow path between the exchanger and the hot water tank. Refrigerant fluid in the evaporator plate assembly absorbs thermal energy from the ambient environment, and the fluid is then compressed by the compressor to increase the temperature thereof. The heated fluid transfers thermal energy to water in the heat exchanger, which is then stored in the tank for use. The hot water can be circulated to furnace coils wherein air is blown over the coils to absorb heat therefrom, and used to heat one or more rooms.

55 Claims, 3 Drawing Sheets

AMBIENT THERMAL ENERGY RECOVERY SYSTEM

BACKGROUND OF THE INVENTION

Heat pumps and solar panels are two types of thermal energy systems, both of which have shortcomings. For example, heat pumps generally are nonfunctional below approximately 20° F., and thus are less practical in colder climates. Solar panels are dependent upon the sun's rays, and therefore do not function at night or on cloudy days. The number of hours and days of sunlight in the particular geographic region are major factors in the usefulness of solar panels.

Some prior art solar panels had water in the panel pipes and utilized large arrays to capture thermal energy from solar radiation for heating the water. A large surface area was required to adequately heat the water. Such systems were impractical in climates having temperatures low enough to freeze the water.

Other prior art solar panel systems attempted to utilize refrigerant gasses in place of water in the solar panels. However, these refrigerant systems were subject to failure due to excessive pressure created by rapid temperature increases in the panels when the panels were exposed to direct sunlight. This rapid temperature and pressure increase often led to failure of the tubing in the panel arrays, and premature failure of the refrigerant compressor. The tubing of the solar panel rays usually was made of soft copper, which is easy to bend and solder. Eventually, such solar panel systems using the refrigerant fluid was dropped due to the failure in the ability to control the rapid changes in the refrigerant gas pressures.

Accordingly, a primary objective of the present invention is the provision of an improved method and means for recovery of thermal energy from an ambient environment.

Another objective of the present invention is the provision of a method and means of thermal energy recovery wherein ambient thermal energy is absorbed in evaporator plates remote from the other components of the system.

Another objective of the present invention is the provision of a method and means for thermal energy recovery using reverse refrigeration technology.

Another objective of the present invention is the provision of a system for recycling thermal energy from ambient air to heat water.

Yet another objective of the present invention is the provision of a thermal energy recycling method wherein ambient thermal energy is absorbed by a refrigerant fluid, which is then compressed and passed through a heat exchanger to transfer thermal energy from the fluid to water, thereby heating the water.

Another objective of the present invention is the provision of a method of thermal energy recovery using an outdoor evaporator plate assembly, and an indoor compressor and heat exchanger.

A further objective of the present invention is the provision of a method and means of thermal energy recovery which functions 24 hours per day.

Yet another objective of the present invention is the provision of a method and means of thermal energy recovery which is not dependent upon direct exposure to solar rays.

Still another objective of the present invention is the provision of a method and means of thermal energy recovery and recycling which is functional down to temperatures of approximately −40° F.

Another objective of the present invention is a system for recovering and recycling thermal energy from an ambient environment, having unused thermal energy.

A further objective of the present invention is the provision of a method and means for thermal energy recovery which is economical to manufacture and install, and durable and efficient in use.

These and other objectives will become apparent from the following description of the invention.

BRIEF SUMMARY OF THE INVENTION

The thermal energy recovery system of the present invention includes an evaporator plate assembly in an ambient environment, such as outdoor air. A compressor and heat exchanger are located indoors, remote from the evaporator plate assembly. A refrigerant fluid circulates through lines connecting the evaporator plate assembly, compressor and heat exchanger. Water circulates through lines connecting the heat exchanger to a hot water storage tank.

In the method of thermal energy recovery, the refrigerant fluid absorbs thermal energy from the ambient air while passing through the evaporator plate assembly. The compressor compresses the refrigerant fluid to increase the temperature of the fluid, which is then passed through the heat exchanger so as to transfer thermal energy from the fluid to the water, thereby heating the water. The water is then stored in the tank. The water can be used for any hot water needs, and can be directed through furnace coils so as to dissipate heat to air blown past the coils for heating one or more rooms.

DETAILED DESCRIPTION OF THE PREFERRED EMBODIMENT

Figure 1:
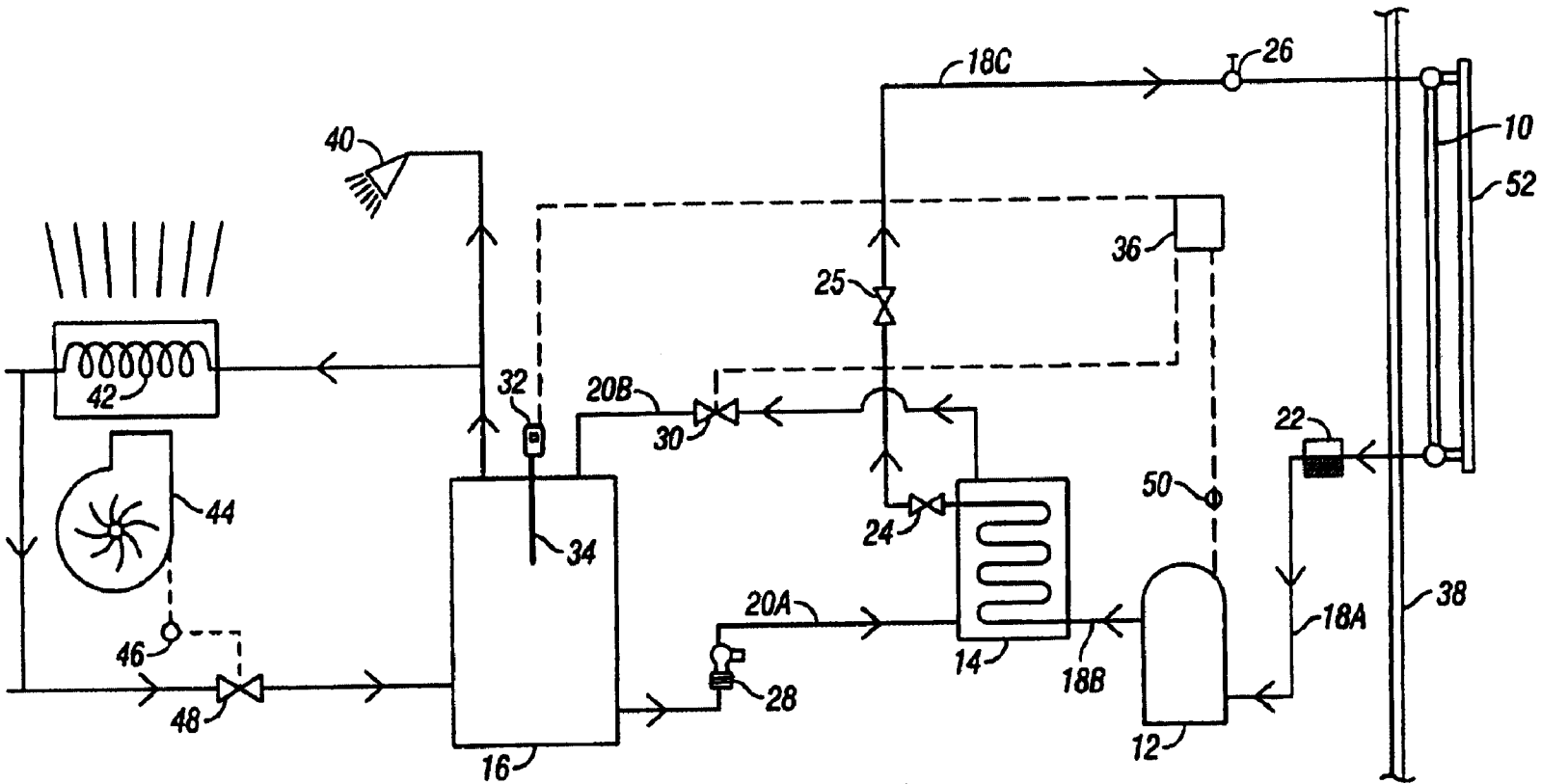
FIG. 1 is a schematic view of the thermal energy recovery system of the present invention.
Figure 2:
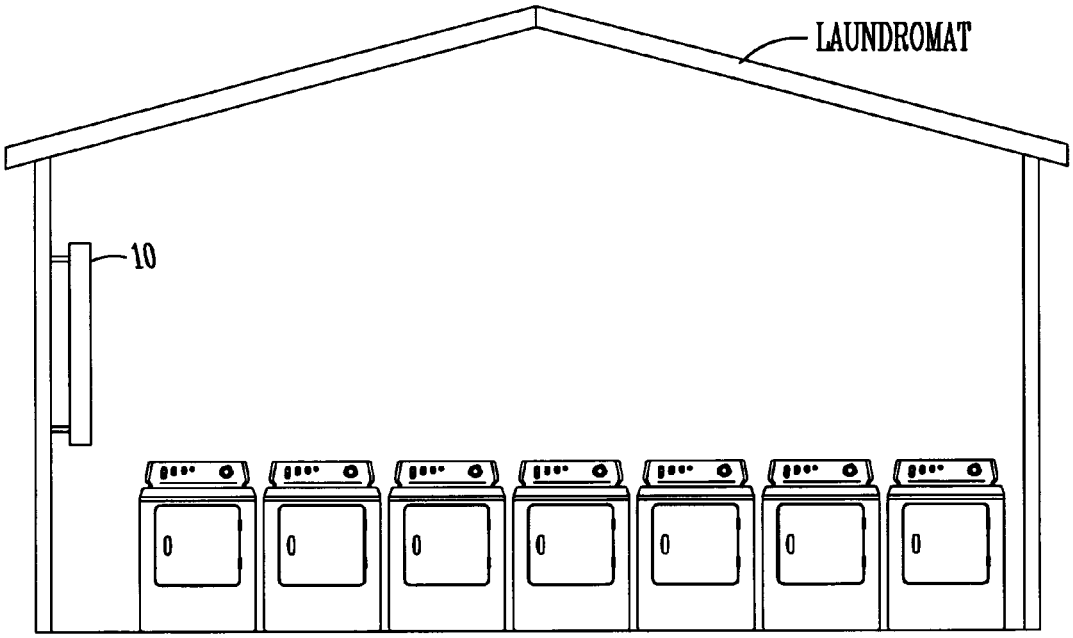
FIG. 2 is a schematic view showing the evaporator plate assembly of the present invention mounted on the wall of a Laundromat having dryers.
Figure 3:
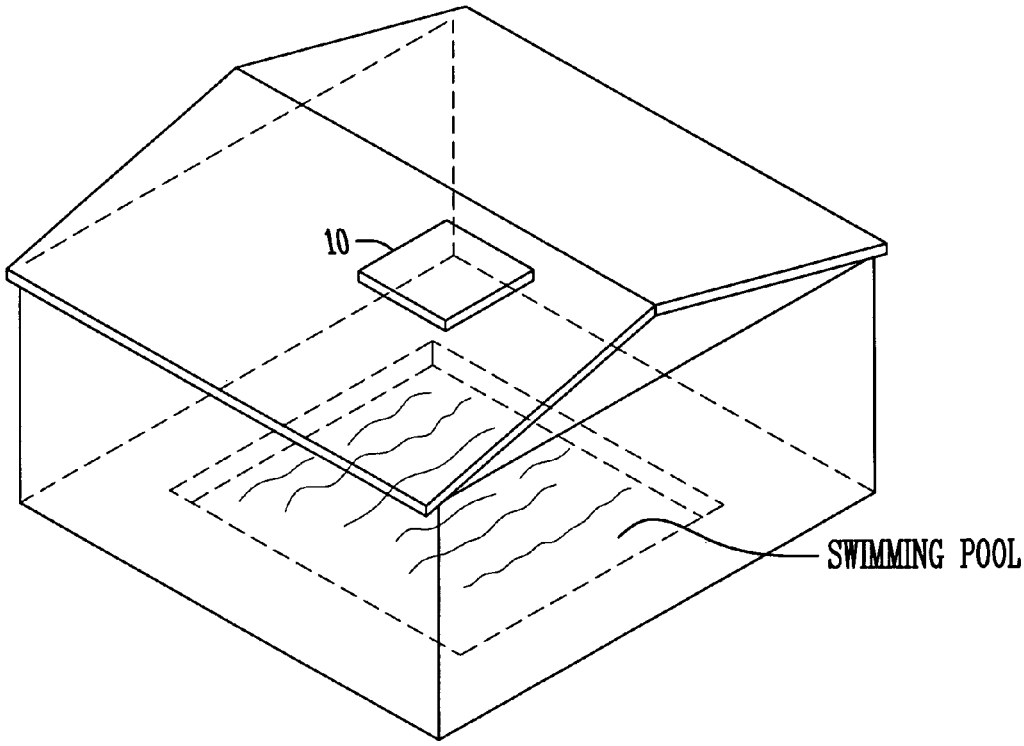
FIG. 3 is a schematic view showing the evaporator plate assembly of the present invention hung or mounted above an indoor swimming pool.
Figure 4:
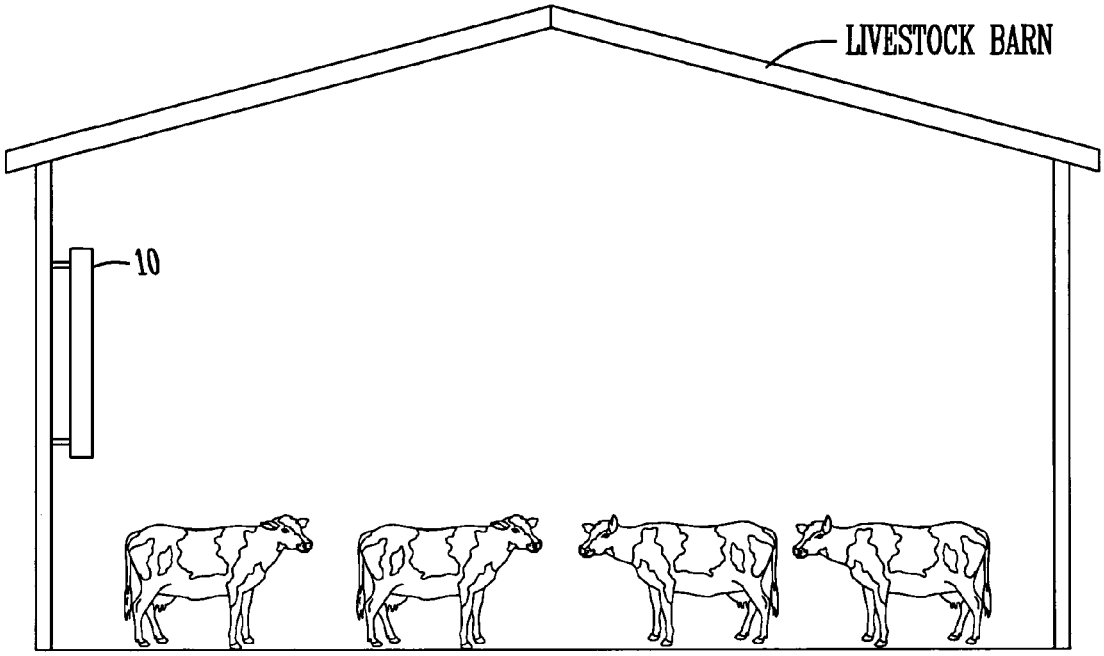
FIG. 4 is a schematic view showing the evaporator plate assembly of the present invention mounted on the wall of a livestock barn.
Figure 5:
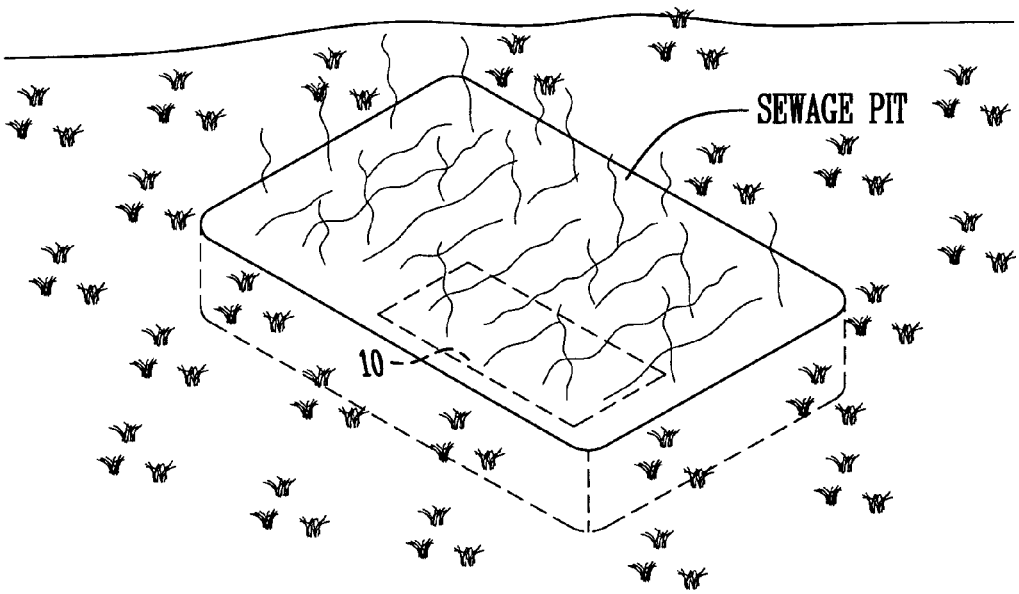
FIG. 5 is a schematic view showing the evaporator plate assembly of the present invention placed in a body of liquid, such as a sewage pit.

The basic components of the thermal energy recovery system of the present invention are an evaporator plate assembly 10, a compressor 12, a heat exchanger 14, and a hot water storage tank 16. Refrigerant fluid lines 18A, B, C provide a closed circuit loop between the evaporator plate assembly 10, the compressor 12, and the heat exchanger 14. The refrigerant fluid lines 18A, B, C are preferably made of hard copper, or similar material which will withstand rapid pressure increases. Soft copper, such as conventionally used in solar panels, will not suffice. Also, in the preferred embodiment, the fluid line 18A between the evaporator plate assembly 10 and the compressor 12 is ¾ inch diameter, while the line 18B between the compressor 12 and the heat exchanger 14 is ⅜ inch diameter. Thus, the fluid line 18A is low pressure, while the line 18B is high pressure. Water lines 20 provide a circuit between the heat exchanger 14 and the hot water storage tank 16. The size of the compressor 12 in the unit will dictate the sizing of the refrigerant fluid lines 18A, B, C.

A refrigerant accumulator 22 is provided in the fluid line 18A so that any moisture in the refrigerant fluid gas in the line 18A may be precipitated out. A refrigerant receiver 24 is provided in the fluid line 18C between the heat exchanger 14 and the evaporator plate assembly 10 and is used as an expansion chamber or tank. A filter dryer 25 is provided in the fluid line 18C between the heat exchanger 14 and the evaporator plate assembly 10 so as to remove any water in the line. An expansion valve 26 is provided in the line 18C so that the refrigerant fluid changes from a liquid state to a gaseous state as the fluid enters the evaporator plate assembly 10.

A water regulating valve 28 is provided in the water line 20A between the storage tank 16 and the heat exchanger 14. A water pump 30 is provided in the water line 20B between the heat exchanger 14 and the storage tank 16. A thermostat 32 with a submersible temperature probe 34 is provided on the hot water storage tank 16.

A controller 36 is electrically connected to the compressor 12, the water pump 30, and the thermostat 32 so as to control operation of the recovery system, as described below. The controller 36 may be any commercially available, such as model number A4196BF-1C, manufactured by Johnson Control.

The most common use of the thermal energy recovery system of the present invention is with ambient air, particularly outdoor air. In such an application, the evaporator plate assembly 10 is mounted outdoors, with the remaining components being mounted indoors. Thus, with the exception of the evaporator panel assembly 10, the remaining components of the system are housed in an environmentally controlled environment. The evaporator plate assembly 10 may be mounted, for example, on an exterior wall 38 of a building or house. It is understood that the evaporator panel 10 may be located in any environment having ambient thermal energy, whether indoors or outdoors. For example, the evaporator panel assembly 10 may be mounted in waste water, such as from a Laundromat or car wash, to absorb thermal energy from the water; in a hog or cattle confinement building to absorb thermal energy in the air from the body heat of the animals; in a sewage pit to absorb thermal energy from the sludge; and in a Laundromat to absorb thermal energy put out by the dryers. The evaporator plate assembly 10 can also be placed in an indoor swimming pool facilities above the pool to recirculate the thermal energy of the water lost to evaporation of the pool water.

In the method of thermal energy recovery according to the present invention, the refrigerant fluid gas passing through the evaporator panel assembly 10 absorbs thermal energy from the ambient environment. The gas is then compressed by the compressor 12 to increase the temperature of the fluid. As the heated fluid flows through the heat exchanger 14, thermal energy is transferred to water in exchanger 14 to heat the water. The heat exchanger 14 is preferably a coaxial or flat plate unit which allows for efficient transfer of heat from the refrigerant fluid to the water. The heated water is stored in the tank 16.

Operation of the compressor 12 is controlled by the controller 36 in response to the temperature of the water in the storage tank 16. When the temperature in the tank 16 drops below a predetermined point, the thermostat 32 sends a signal to the controller 36 which actuates the compressor 12 so that fluid is pumped through the refrigerant fluid lines 18A, B, C. Simultaneously, the controller 6 actuates the water pump 30 so that water is circulated to and from the heat exchanger 14 through the lines 20A, B. When the temperature of the water in the tank increases to a predetermined level, the thermostat 32 sends a signal to the controller 36, which shuts off the compressor 12 and the water pump 30. The thermostat therefore turns the system on and off predetermined set points. Preferably, the water in tank 16 does not exceed the 120° F., as a safety precaution to preclude burning of a person using the hot water.

A pressure switch 50 is provided in the electrical connection between the compressor 12 and the controller 36 so as to shut off the compressor 12 in the event that there is an excessive pressure build up in the compressor 12. A preferred pressure shut off level is approximately 350 psi.

The water in the tank 16 can be used for numerous needs, such as a shower 40, or for a dishwasher or clothes washer. Also, the hot water can be supplied to coils 42 in a furnace, with a fan or blower 44 blowing air past the coils 42 to heat the air which can then be distributed to one or more rooms. The blower 44 is controlled by a thermostat 46, which also controls a water pump 48 to circulate water between the storage tank 16 and the furnace coils 42.

The evaporator plate assembly 10 functions passively to absorb thermal energy ambient environment. No fan or blower is utilized to force air past the assembly, as in conventional heat pump. Also, since the present system is not used for cooling a room, as is a heat pump, and therefore does not utilize a four-way valve and other more complex pump components. Also, in contrast to a heat pump wherein the compressor and heat exchanger are located outdoors and become nonfunctional below 20° F., the compressor and heat exchanger of the present invention is are located indoors where colder temperatures are not a factor.

The thermal energy recovery method and means of the present invention is a reverse refrigeration technique which absorbs thermal energy from any source at any time, as long as the ambient environment temperature exceeds the boiling point of the refrigerant fluid. A preferred fluid is Freon, which boils at −41° F. Thus, the system will function at temperatures above −40° F., with efficiencies improving as the temperature increases. In an application wherein the plate assembly 10 is absorbing thermal energy from outside air, the system will function 24 hours per day, since there is no need for direct solar rays. Preferably, when the evaporator panel assembly is mounted outdoors, the assembly is located to avoid direct exposure to solar radiation, such as on the north side of a building, so as to prevent sudden pressure increases in the fluid lines, 20A, B, C. Alternatively, a protective cover 52 can be positioned over the assembly 10 to protect the tubing therein from direct exposure to the sun's rays. In other words, the energy from direct sunlight heats the air surrounding the evaporator panel assembly 10, rather than heating the assembly directly, which causes undesirable pressure radiance potential failure of the system. Also, by lowering the working pressure in the system, the compressor can be simplified. For example, the lower pressure eliminates the need for a highly technical variable rotational speed compressor which is difficult to maintain and requires computer technology to operate.

The recovered thermal energy, recovered from the various sources of thermal energy, can also be used as an energy input for different fluids and processes that require the addition of thermal energy to be more efficient. The processes may include heating of soybean oil, heating of ethanol mash, heating of fluids used in radiant floor systems, transfer of thermal energy from one system to a secondary system such as space heating, or adding energy to heat sewage for recovery of greenhouse gasses such as methane.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of thermal energy recovery, comprising:

placing an evaporator plate assembly outdoors and placing a compressor and heat exchanger indoors;

absorbing thermal energy from out door air into the evaporator plate assembly having a refrigerant fluid therein;

compressing the refrigerant fluid with the compressor to increase the temperature of the fluid;

passing the fluid and water through the heat exchanger so as to transfer thermal energy from the fluid to the water thereby heating the water; and storing the heated water for use.

2. The method of claim 1 further comprising regulating flow of water through the heat exchanger in response to the temperature of the stored water.

3. The method of claim 1 further comprising sensing the temperature of the stored water and controlling operation of the compressor in response to the temperature of the stored water.

4. The method of claim 1 further comprising passing the heated water through coils and blowing air across the coils to transfer thermal energy from the water to the air and thereby heat the air.

5. The method of claim 1 further comprising using the heated water to heat a room.

6. A system for recovering thermal energy from an ambient environment, comprising:

an evaporator plate assembly in the ambient environment;

a compressor;

a heat exchanger;

a hot water storage tank;

refrigerant fluid lines providing a fluid circuit between the evaporator plate assembly, compressor and heat exchanger;

water lines providing a fluid circuit between the heat exchanger and hot water storage tank;

a hot water supply line from the storage tank to a remote site;

refrigerant fluid flowable through the fluid lines whereby the fluid absorbs thermal energy from the ambient environment while in the evaporator plate assembly; water flowable through the water lines whereby thermal energy is transferred in the heat exchanger from the fluid to the water so as to heat the water; and the compressor, heat exchanger, and tank being remote from the ambient environment.

7. The system of claim 6 wherein the evaporator plate assembly is outdoors and the compressor, heat exchanger and tank are indoors.

8. The system of claim 6 further comprising a temperature probe in the storage tank to sense the temperature of the heated water.

9. The system of claim 6 further comprising a controller for regulating water flow through the heat exchanger in response to temperature of the water in the storage tank.

10. The system of claim 6 further comprising a controller for controlling operation of the compressor in response to temperature of the water in the storage tank.

11. The system of claim 6 further comprising a coil fluidly connected to receive water from the storage tank, and a fan to blow air across the coil and thereby transfer thermal energy from the water in the coil to the air so as to heat the air.

12. A method of thermal energy recovery, comprising:

absorbing thermal energy from an ambient environment into an evaporator plate assembly having a refrigerant fluid therein;

compressing the refrigerant fluid to increase the temperature of the fluid;

passing the fluid and water through a heat exchanger so as to transfer thermal energy from the fluid to the water thereby heating the water;

storing the heated water for use; and passing the heated water through coils and blowing air across the coils to transfer thermal energy from the water to the air and thereby heat the air.

13. The method of claim 12 further comprising placing the evaporator plate assembly outdoors and placing the compressor and heat exchanger indoors.

14. The method of claim 12 further comprising regulating flow of water through the heat exchanger in response to the temperature of the stored water.

15. The method of claim 12 further comprising sensing the temperature of the stored water and controlling operation of the compressor in response to the temperature of the stored water.

16. A method of thermal energy recovery, comprising:

assembly absorbing thermal energy from an ambient environment into an evaporator plate assembly having a refrigerant fluid therein;

compressing the refrigerant fluid to increase the temperature of the fluid;

passing the fluid and water through a heat exchanger so as to transfer thermal energy from the fluid to the water thereby heating the water;

storing the heated water for use; and using the heated water to heat a room.

17. The method of claim 16 further comprising placing the evaporator plate assembly outdoors and placing the compressor and heat exchanger indoors.

18. The method of claim 16 further comprising regulating flow of water through the heat exchanger in response to the temperature of the stored water.

19. The method of claim 16 further comprising sensing the temperature of the stored water and controlling operation of the compressor in response to the temperature of the stored water.

20. The method of claim 16 further comprising passing the heated water through coils and blowing air across the coils to transfer thermal energy from the water to the air and thereby heat the air.

21. A system for recovering thermal energy from an ambient environment, comprising:

an evaporator plate assembly in the ambient environment;

a compressor;

a heat exchanger;

a hot water storage tank;

refrigerant fluid lines providing a fluid circuit between the evaporator plate assembly, compressor and heat exchanger;

water lines providing a fluid circuit between the heat exchanger and hot water storage tank;

a hot water supply line from the storage tank to a remote site;

refrigerant fluid flowable through the fluid lines whereby the fluid absorbs thermal energy from the ambient environment while in the evaporator plate assembly; and water flowable through the water lines whereby thermal energy is transferred in the heat exchanger from the fluid to the water so as to heat the water; and the evaporator plate assembly being outdoors and the compressor, heat exchanger and tank being indoors.

22. The system of claim 21 further comprising a temperature probe in the storage tank to sense the temperature of the heated water.

23. The system of claim 21 further comprising a controller for regulating water flow through the heat exchanger in response to temperature of the water in the storage tank.

24. The system of claim 21 further comprising a controller for controlling operation of the compressor in response to temperature of the water in the storage tank.

25. The system of claim 21 further comprising a coil fluidly connected to receive water from the storage tank, and a fan to blow air across the coil and thereby transfer thermal energy from the water in the coil to the air so as to heat the air.

26. A system for recovering thermal energy from an ambient environment, comprising:

an evaporator plate assembly in the ambient environment;

a compressor;

a heat exchanger;

a hot water storage tank;

refrigerant fluid lines providing a fluid circuit between the evaporator plate assembly, compressor and heat exchanger;

water lines providing a fluid circuit between the heat exchanger and hot water storage tank;

a hot water supply line from the storage tank to a remote site;

refrigerant fluid flowable through the fluid lines whereby the fluid absorbs thermal energy from the ambient environment while in the evaporator plate assembly; and water flowable through the water lines whereby thermal energy is transferred in the heat exchanger from the fluid to the water so as to heat the water; and a protective cover on the evaporator plate assembly to protect the assembly from direct exposure to solar rays.

27. The system of claim 26 wherein the evaporator plate assembly is outdoors and the compressor, heat exchanger and tank are indoors.

28. The system of claim 26 further comprising a temperature probe in the storage tank to sense the temperature of the heated water.

29. The system of claim 26 further comprising a controller for regulating water flow through the heat exchanger in response to temperature of the water in the storage tank.

30. The system of claim 26 further comprising a controller for controlling operation of the compressor in response to temperature of the water in the storage tank.

31. The system of claim 26 further comprising a coil fluidly connected to receive water from the storage tank, and a fan to blow air across the coil and thereby transfer thermal energy from the water in the coil to the air so as to heat the air.

32. A system for recovering thermal energy from an ambient environment, comprising:

an evaporator plate assembly in the ambient environment;

a compressor;

a heat exchanger;

a hot water storage tank;

refrigerant fluid lines providing a fluid circuit between the evaporator plate assembly, compressor and heat exchanger;

water lines providing a fluid circuit between the heat exchanger and hot water storage tank;

a hot water supply line from the storage tank to a remote site;

refrigerant fluid flowable through the fluid lines whereby the fluid absorbs thermal energy from the ambient environment while in the evaporator plate assembly;

water flowable through the water lines whereby thermal energy is transferred in the heat exchanger from the fluid to the water so as to heat the water; and a temperature probe in the storage tank to sense the temperature of the heated water.

33. The system of claim 32 wherein the evaporator plate assembly is outdoors and the compressor, heat exchanger and tank are indoors.

34. The system of claim 32 further comprising a controller for regulating water flow through the heat exchanger in response to temperature of the water in the storage tank.

35. The system of claim 32 further comprising a controller for controlling operation of the compressor in response to temperature of the water in the storage tank.

36. The system of claim 32 further comprising a coil fluidly connected to receive water from the storage tank, and a fan to blow air across the coil and thereby transfer thermal energy from the water in the coil to the air so as to heat the air.

37. A method of thermal energy recovery, comprising:

absorbing thermal energy from a liquid environment into an evaporator plate assembly having a refrigerant fluid therein;

compressing the refrigerant fluid to increase the temperature of the fluid; and passing the fluid and water through a heat exchanger so as to transfer thermal energy from the fluid to the water thereby heating the water.

38. The method of claim 37 further comprising storing the heated water for use and regulating flow of water through the heat exchanger in response to the temperature of the stored water.

39. The method of claim 37 further comprising storing the heated water for use and sensing the temperature of the stored water and controlling operation of the compressor in response to the temperature of the stored water.

40. A system for recovering thermal energy from an indoor environment, comprising:

an evaporator plate assembly in the indoor environment;

a compressor;

a heat exchanger;

a hot water storage tank;

refrigerant fluid lines providing a fluid circuit between the evaporator plate assembly, compressor and heat exchanger;

water lines providing a fluid circuit between the heat exchanger and hot water storage tank;

a hot water supply line from the storage tank to a remote site;

refrigerant fluid flowable through the fluid lines whereby the fluid absorbs thermal energy from the indoor environment while in the evaporator plate assembly; and water flowable through the water lines whereby thermal energy is transferred in the heat exchanger from the fluid to the water so as to heat the water.

41. The system of claim 40 further comprising a controller for regulating water flow through the heat exchanger in response to temperature of the water in the storage tank.

42. The system of claim 40 further comprising a controller for controlling operation of the compressor in response to temperature of the water in the storage tank.

43. A system for recovering thermal energy from a liquid environment, comprising:

an evaporator plate assembly in the liquid environment;

a compressor;

a heat exchanger;

a hot water storage tank;

refrigerant fluid lines providing a fluid circuit between the evaporator plate assembly, compressor and heat exchanger;

water lines providing a fluid circuit between the heat exchanger and hot water storage tank;

a hot water supply line from the storage tank to a remote site;

refrigerant fluid flowable through the fluid lines whereby the fluid absorbs thermal energy from the liquid environment while in the evaporator plate assembly; and water flowable through the water lines whereby thermal energy is transferred in the heat exchanger from the fluid to the water so as to heat the water.

44. The system of claim 43 further comprising a controller for regulating water flow through the heat exchanger in response to temperature of the water in the storage tank.

45. The system of claim 43 further comprising a controller for controlling operation of the compressor in response to temperature of the water in the storage tank.

46. The system of claim 43 further comprising a coil fluidly connected to receive water from the storage tank, and a fan to blow air across the coil and thereby transfer thermal energy from the water in the coil to the air so as to heat the air.

47. A method of thermal energy recovery, comprising:

absorbing thermal energy from an indoor environment into an evaporator plate assembly having a refrigerant fluid therein;

compressing the refrigerant fluid to increase the temperature of the fluid;

passing the fluid and water through a heat exchanger so as to transfer thermal energy from the fluid to the water thereby heating the water; and storing the heated water for use and regulating flow of water through the heat exchanger in response to the temperature of the stored water.

48. A method of thermal energy recovery, comprising:

absorbing thermal energy from an indoor environment into an evaporator plate assembly having a refrigerant fluid therein;

compressing the refrigerant fluid to increase the temperature of the fluid;

passing the fluid and water through a heat exchanger so as to transfer thermal energy from the fluid to the water thereby heating the water; and storing the heated water for use, sensing the temperature of the stored water and controlling operation of the compressor in response to the temperature of the stored water.

49. A method of thermal energy recovery, comprising:

absorbing thermal energy from a non-solar source with an evaporator plate exposed to the source;

transferring the thermal energy absorbed by the evaporator plate to water so as to heat the water; and wherein the source is a liquid.

50. A method of thermal energy recovery, comprising:

absorbing thermal energy from a non-solar source with an evaporator plate exposed to the source;

transferring the thermal energy absorbed by the evaporator plate to water so as to heat the water; and wherein the source is livestock body heat.

51. A method of thermal energy recovery, comprising:

absorbing thermal energy from a non-solar source with an evaporator plate exposed to the source;

transferring the thermal energy absorbed by the evaporator plate to water so as to heat the water; and wherein the source is hot air from a clothes dryer.

52. A method of thermal energy recovery, comprising:

absorbing thermal energy from a non-solar source with an evaporator plate exposed to the source;

transferring the thermal energy absorbed by the evaporator plate to water so as to heat the water; and wherein the source is evaporated pool water.

53. A method of thermal energy recovery, comprising:

absorbing thermal energy from a non-solar source with an evaporator plate exposed to the source;

transferring the thermal energy absorbed by the evaporator plate to water so as to heat the water; and wherein the source is waste water.

54. A method of thermal energy recovery, comprising:

absorbing thermal energy from a non-solar source with an evaporator plate exposed to the source;

transferring the thermal energy absorbed by the evaporator plate to water so as to heat the water; and wherein the source is a sewage pit.

55. A method of thermal energy recovery, comprising:

absorbing thermal energy from a non-solar source with an evaporator plate exposed to the source;

transferring the thermal energy absorbed by the evaporator plate to water so as to heat the water; and using the heated water to heat a room.

* * * * *